US008751135B2

(12) United States Patent
Girotto et al.

(10) Patent No.: US 8,751,135 B2
(45) Date of Patent: Jun. 10, 2014

(54) METHOD TO DIAGNOSE A FAULT IN A FUEL INJECTION SYSTEM OF AN INTERNAL COMBUSTION ENGINE

(75) Inventors: Marco Girotto, Turin (IT); Tommaso De Fazio, Turin (IT); Michele Bastianelli, Camerano (IT)

(73) Assignee: GM Global Technology Operations LLC, Detroit, MI (US)

( * ) Notice: Subject to any disclaimer, the term of this patent is extended or adjusted under 35 U.S.C. 154(b) by 709 days.

(21) Appl. No.: 13/048,491

(22) Filed: Mar. 15, 2011

(65) Prior Publication Data

US 2011/0224888 A1 Sep. 15, 2011

(30) Foreign Application Priority Data

Mar. 15, 2010 (GB) ..... 1004260.4

(51) Int. Cl.
*F02D 41/30* (2006.01)
*F02D 41/22* (2006.01)

(52) U.S. Cl.
USPC ..... 701/103; 123/198 DB; 73/114.38; 73/40

(58) Field of Classification Search
USPC ..... 701/102–105, 110, 114, 115, 84, 86, 701/99; 123/198 DB, 479, 352; 73/40, 49.7, 73/114.38, 114.45, 116.02
See application file for complete search history.

(56) References Cited

U.S. PATENT DOCUMENTS

| | | | | |
|---|---|---|---|---|
| 6,564,616 | B2 * | 5/2003 | Antonioli et al. | 73/114.38 |
| 7,235,033 | B2 | 6/2007 | Eriksson et al. | |
| 7,962,277 | B2 * | 6/2011 | Hofmeister et al. | 701/104 |
| 2008/0262697 | A1 | 10/2008 | Gangi et al. | |

FOREIGN PATENT DOCUMENTS

| | | | |
|---|---|---|---|
| DE | 102004044808 | A1 | 4/2006 |
| FR | 2837876 | A1 | 10/2003 |
| FR | 2919678 | A1 | 2/2009 |
| JP | 2008014198 | A | 1/2008 |
| WO | 2004052676 | A1 | 6/2004 |

OTHER PUBLICATIONS

British Patent Office, British Search Report for British Application No. 1004260.4, dated Jun. 29, 2010.

* cited by examiner

*Primary Examiner* — Hieu T Vo
(74) *Attorney, Agent, or Firm* — Ingrassia Fisher & Lorenz, P.C.

(57) ABSTRACT

A method is provided to diagnose a fault in a fuel injection system of an internal combustion engine. The method includes, but is not limited to commanding an injection pulse for injecting a test quantity of fuel into an engine cylinder, determining the torque released to an engine crankshaft due to the injection pulse, calculating the difference between this released torque and an expected value for the torque, and of detecting a fault in the fuel injection system if the difference exceeds a threshold.

16 Claims, 2 Drawing Sheets

METHOD TO DIAGNOSE A FAULT IN A FUEL INJECTION SYSTEM OF AN INTERNAL COMBUSTION ENGINE

CROSS-REFERENCE TO RELATED APPLICATION

This application claims priority to British Patent Application No. 1004260.4, filed Mar. 15, 2010, which is incorporated herein by reference in its entirety.

TECHNICAL FIELD

The technical field relates to a method for diagnosing a fault in a fuel injection system of an internal combustion engine, typically a Diesel engine, of a motor vehicle.

BACKGROUND

In order to comply with tighter emission regulations, the motor vehicle must be provided with an On Board Diagnostic (OBD) system, for checking the proper operation of the vehicle sub-systems that can affect the polluting emissions. Since the polluting emissions strongly depend on the quality of the fuel combustion into the engine cylinders, the regulations generally require the OBD system to detect also the malfunctions of the engine fuel injection system.

The fuel injection system of modern Diesel engines comprises at least a fuel injector per engine cylinder, and a fuel pump that draws the fuel from a tank and delivers it in pressure to a fuel rail connected with all the fuel injectors. The fuel injectors are generally governed by an engine control unit (ECU) according to a multi-injection pattern, which provides for each fuel injector to perform a plurality of injection pulses per engine cycle.

Each injection pulse is characterized by an individual quantity of fuel to be injected, and by a timing at which said individual quantity of fuel must be injected. The injection timing depends on the instant at which the ECU commands the fuel injector to open, also referred as Start Of Injection (SOI), which can be expressed in temporal term as well as in term of angular position of the engine crankshaft. The individual fuel quantity depends on the opening time of the fuel injector, namely the time between the instant at which the ECU commands the fuel injector to open (SOI) and the instant at which the ECU commands the fuel injector to close, also referred as Energizing Time (ET). If a malfunction of the fuel injection system arises, the individual fuel quantity actually injected by each injection pulse may not correspond to that expected in response of the respective energizing time.

In order to overcome this drawback, most ECU implements a compensation strategy that automatically correct the energizing time of each injection pulse, in order to actually achieve a desired individual fuel quantity. Nevertheless, a malfunction of the fuel injection system may also cause the timing of each injection pulse to drift with respect to that expected.

This injection timing fault is particularly due to damages occurred by the mechanical devices driving the fuel injector, to errors of the ECU computing, or to injection drifts caused by production spread or aging of the fuel injectors. Since the injection timing has a very strict relationship with the quality of the combustion within the engine cylinders, wrong injection timing can cause the polluting emissions to exceed the maximum levels set by the regulation.

As a consequence, this regulation generally provides for the OBD system to detect a malfunction of the fuel injection system when the system is unable to deliver fuel at the proper crank angle/timing (e.g. injection timing too advanced or too retarded) necessary to maintain a vehicle's NMHC, CO, NOx, and PM emissions at, or below, an applicable emission level. In order to fulfill this requirement, a known solution uses the energizing time corrections that are determined by the above mentioned compensation strategy, and detects the malfunction of the fuel injection system when said energizing time corrections exceed a calibrated threshold.

In greater detail, the known solution provides for commanding an injection pulse to inject a desired fuel quantity, for monitoring the energizing time actually used for injecting said desired fuel quantity, and for generating an alert signal if the difference between the actual energizing time and the expected energizing time exceeds the above mentioned threshold. As a matter of fact, this known solution is based on the assumption that, when the energizing time corrections are too great, the fuel injection system is malfunctioning to the point that also the injection timing is suspected to drift.

However, this assumption represents the major deficiency of this known solution, because actually there is not an immediate and necessary relationship between energizing time, injection timing and combustion quality.

In view of the above, it is at least one object to provide an improved method for detecting injection timing faults of a fuel injection system. Another object of the present invention is to achieve the above mentioned goal with a simple, rational and rather inexpensive solution. In addition, other objects, desirable features and characteristics will become apparent from the subsequent summary and detailed description, and the appended claims, taken in conjunction with the accompanying drawings and this background.

SUMMARY

An embodiment provides a method to diagnose a fault in a fuel injection system of an internal combustion engine, comprising the steps of commanding an injection pulse for injecting a test quantity of fuel into an engine cylinder, of determining the torque released to an engine crankshaft due to a combustion of said injected fuel quantity, of calculating the difference between this torque and an expected value for said torque, and of diagnosing a fault in the fuel injection system if said difference exceeds a threshold value.

This strategy is based on the assumption that the torque released to the crankshaft is strongly affected by the quality of the combustion within the engine cylinders, which in turn has a very strict relationship with the injection timing, so that there is an immediate and necessary relationship also between the injection timing and the released torque. As a consequence, this new strategy provides a more reliable way to detect whether the fuel injection system is able to provide the desired injection timing.

According to an embodiment, the expected value is determined through an empirically determined map correlating the expected value with one or more engine operating parameters, such as for example engine speed, intake air mass flow, injected fuel quantity and other. This embodiment has at least the advantage that the map can be determined with an experimental activity and then stored in a data carrier, thereby simplifying the diagnosis of the injection system faults.

According to another embodiment, the test injection pulse is commanded during a fuel cut-off phase of the engine. This embodiment has the advantage that the diagnostic method does not affect the standard fuel injection strategy during the normal operation of the engine.

According to still another aspect of the invention, the test quantity of fuel is less than approximately 1 $mm^3$. This small injected fuel quantity has the advantage of releasing to the crankshaft a torque that is generally not perceived by the driver.

According to an embodiment, the released torque is determined as a function of a rotational speed variation of the engine crankshaft due to said injection pulse. This embodiment is based on the assumption that there is a strict relationship between the torque released at the crankshaft and the rotational speed of the latter, so that is quite simple to calculate the released torque as a function of the rotational speed variation.

According to another embodiment, the rotational speed of the crankshaft is measured by means of an encoder associated to the crankshaft. As a matter of fact, the modern engines are always provided with an encoder associated to the crankshaft for other managing purposes, so that this solution allows a simple and economical way to monitor the crankshaft rotational speed also while performing the diagnostic method here concerned.

According to another embodiment, the diagnostic method comprises the further step of performing an emergency procedure when the released torque falls outside a torque range which comprises the expected value of said torque. This embodiment advantageously allows the diagnostic method to face up to an excessive drift of the injection timing, when this excessive drift is detected.

According to another embodiment, the emergency procedure provides for generating an alert signal. This aspect provides a simple and economic way to signal the malfunction of the fuel injection system.

The embodiments of the method described above may be carried out with the help of a computer program comprising a program code or computer readable instructions for carrying out all the method steps described above. The computer program can be stored on a data carrier or, in general, a computer readable medium or storage unit, to represent a computer program product. The storage unit may be a CD, DVD, a hard disk, a flash memory or the like. The computer program can be also embodied as an electromagnetic signal, the signal being modulated to carry a sequence of data bits which represent a computer program to carry out all steps of the methods.

The computer program may reside on or in a data carrier, e.g. a flash memory, which is data connected with a control apparatus for an internal combustion engine. The control apparatus has a microprocessor which receives computer readable instructions in form of parts of said computer program and executes them. Executing these instructions amounts to performing the steps of the method as described above, either wholly or in part.

The electronic control unit 60 or, in general, an ECA (Electronic Control Apparatus) can be a dedicated piece of hardware such as an ECU (Electronic Control Unit), which is commercially available and thus known in the art, or can be an apparatus different from such an ECU, e.g., an embedded controller. If the computer program is embodied as an electromagnetic signal as described above, then the electronic control apparatus, e.g. the ECU or ECA, has a receiver for receiving such a signal or is connected to such a receiver placed elsewhere. The signal may be transmitted by a programming robot in a manufacturing plant. The bit sequence carried by the signal is then extracted by a demodulator connected to the storage unit, after which the bit sequence is stored on or in said storage unit of the ECU or ECA.

Another embodiment relates to an apparatus for diagnosing a fault in a fuel injection system of an internal combustion engine. The apparatus comprises means for commanding an injection pulse for injecting a test quantity of fuel into an engine cylinder, means for determining the torque released to an engine crankshaft due to a combustion of said test quantity of fuel, means for calculating the difference between this torque and an expected value for said torque and means for diagnosing a fault if said difference exceeds a threshold value. This apparatus reliably detects whether the fuel injection system is able to provide the desired injection timing.

An embodiment of the apparatus has determination means for carrying out a determination through an empirically determined map correlating the expected value with one or more engine operating parameters, such as for example engine speed, intake air mass flow, injected fuel quantity and other. This embodiment has the advantage that the map can be determined with an experimental activity and then stored in a data carrier, thereby simplifying the diagnosis of the injection system faults.

Another embodiment of said apparatus has means for commanding configured to command during a fuel cut-off phase of the engine. This aspect of the invention has the advantage that the apparatus does not affect the standard fuel injection strategy during the normal operation of the engine. A further embodiment of the apparatus has means for commanding being configured to use a test quantity of fuel being less than 1 $mm^3$. This small injected fuel quantity has the advantage of releasing to the crankshaft a torque that is generally not perceived by the driver.

Still another embodiment has determination means being configured to determine the released torque as a function of a rotational speed variation of the engine crankshaft due to said injection pulse. This embodiment of the invention is based on the assumption that there is a strict relationship between the torque released at the crankshaft and the rotational speed of the latter, so that is quite simple to calculate the released torque as a function of the rotational speed variation.

A further embodiment comprises an encoder for measuring the rotational speed of the crankshaft, said encoder being associated with the crankshaft. As a matter of fact, the modern engines are always provided with an encoder associated to the crankshaft for other managing purposes, so that this solution allows a simple and economic way to monitor the crankshaft rotational speed also while performing the diagnostic method here concerned.

Still another embodiment of the apparatus has means for performing an emergency procedure when the released torque falls outside a torque range which comprises the expected value of said torque. This embodiment advantageously allows the apparatus to face up to an excessive drift of the injection timing, when this excessive drift is detected. It is furthermore possible to choose an apparatus wherein said performing means are configured to provide an emergency procedure for generating an alert signal, for example by activating an indicator light on the dashboard of the vehicle.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
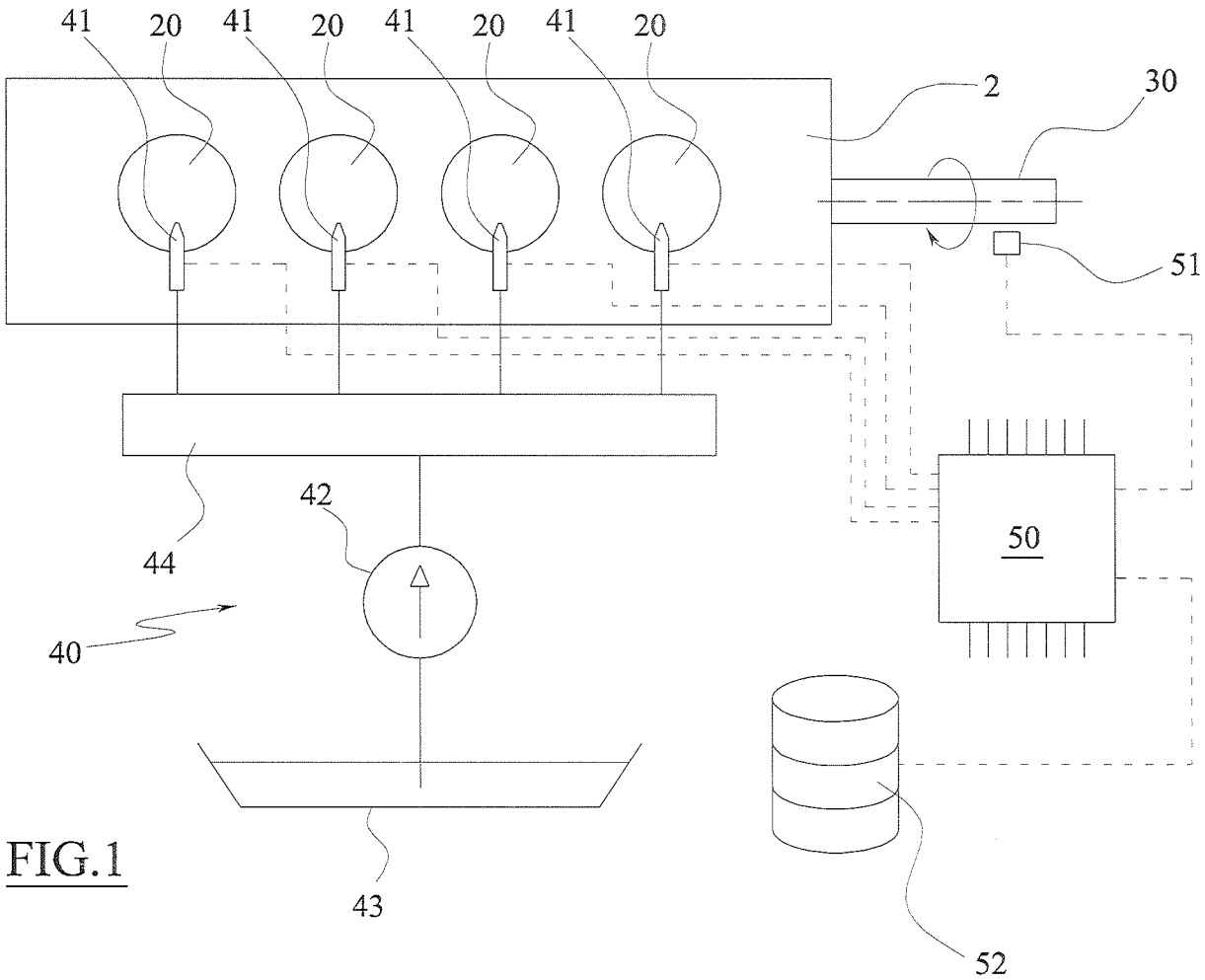
FIG. 1 is a schematic representation of a Diesel engine.

The following detailed description is merely exemplary in nature and is not intended to limit the application and uses.

Furthermore, there is no intention to be bound by any theory presented in the preceding background or summary or the following detailed description.

An embodiment of the invention is hereinafter described with reference to a Diesel engine 10 of a motor vehicle. The Diesel engine 10 schematically comprises a plurality of cylinders 20, in each of which a piston (not shown) reciprocates due to the fuel combustion, so as to rotate a crankshaft 30. The fuel is supplied by means of a fuel injection system 40 arranged for injecting fuel directly into the engine cylinders 20.

The fuel injection system 40 schematically comprises a fuel injector 41 per engine cylinder 20, and a fuel pump 42 that draws the fuel from a tank 43 and delivers it under pressure into a fuel rail 44 connected to all fuel injectors 41. Each fuel injector 41 is governed by an Engine Control Unit (ECU) 50, which opens and closes the fuel injector 41 so as to perform single injections of fuel which are conventionally referred as injection pulses.

In greater detail, during normal operation of the Diesel engine 10, namely when the accelerator pedal (non shown) is at least partially pushed, the ECU 50 carries out a standard injection strategy that provides for each fuel injector 41 to perform a plurality of injection pulses per engine cycle, according to a determined multi-injection pattern. Each injection pulse is conventionally controlled by the ECU 50 on the base of two key parameters, including the individual quantity of fuel to be injected, and the timing at which said individual quantity of fuel must be injected.

The injection timing is determined by the instant at which the ECU 50 commands the fuel injector 41 to open, also referred as Start Of Injection (SOI), which can be expressed either in temporal term or in term of angular position of the crankshaft 30. The individual injected fuel quantity is determined by the opening time of the fuel injector 41, namely the time between the instant at which the ECU 50 commands the fuel injector 41 to open and the instant at which the ECU 50 commands the fuel injector 41 to close, also referred as Energizing Time (ET). Both the SOI and the ET are determined by the ECU 50 taking into account a plurality of engine operating parameters, such as engine speed, engine load, coolant temperature, fuel rail internal pressure and other.

An embodiment provides a diagnostic test for detecting a malfunction of the fuel injection system 40 when the system is unable to deliver fuel at the proper timing. The diagnostic test is performed while the Diesel engine 10 is in a fuel cut-off phase, namely when the accelerator pedal is completely released and the standard injection strategy provides for maintaining the fuel injectors close. In this way, the diagnostic test does not affect the normal operation of the Diesel engine 10.

Figure 2:
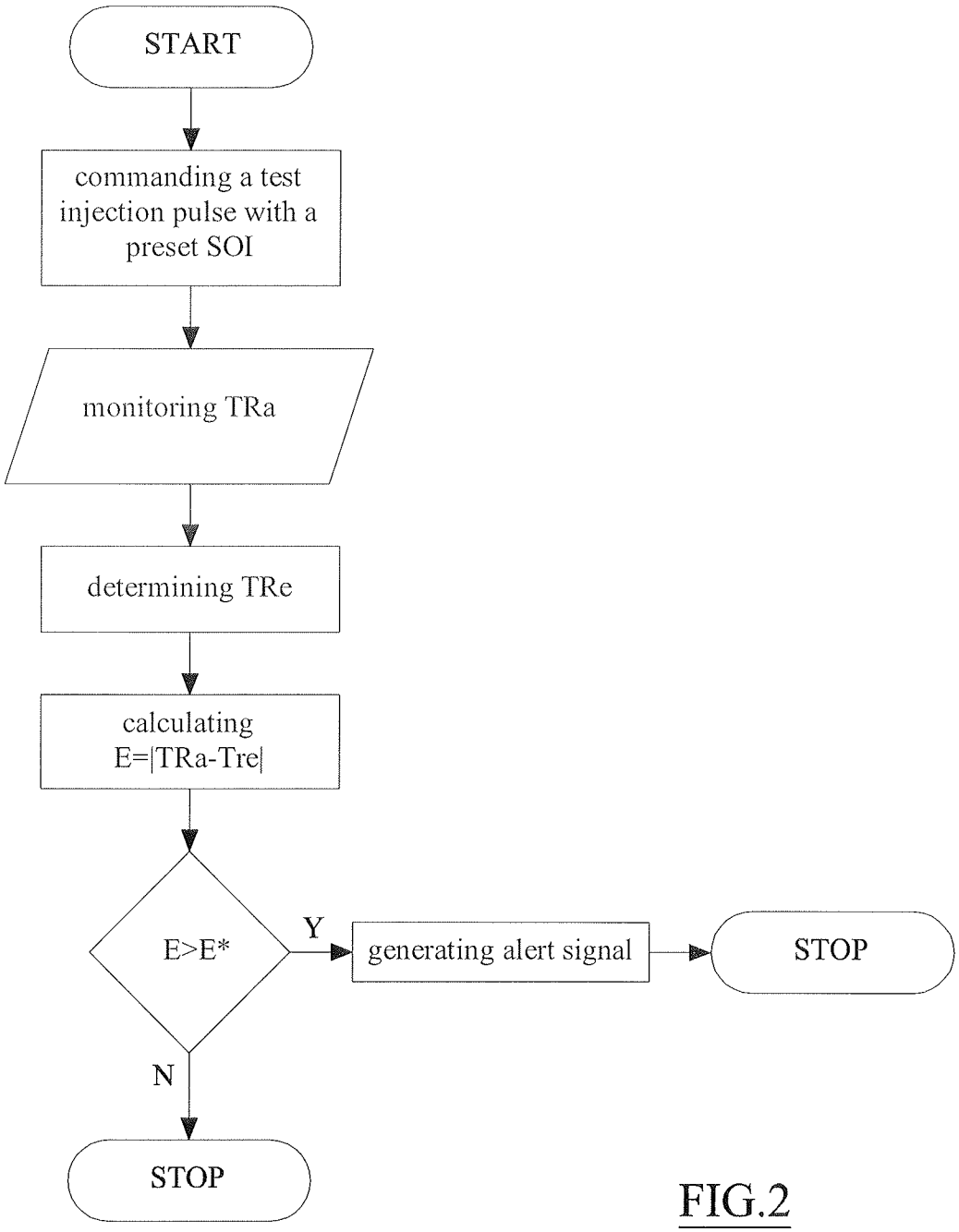
FIG. 2 is a flowchart representing a diagnostic method according to an embodiment.

Referring now to FIG. 2, the diagnostic test firstly provides for commanding a fuel injector 41 to perform an injection pulse at a preset SOI, in order to inject a test quantity of fuel into the respective engine cylinder 20. The test fuel quantity is a small quantity, typically not greater than 1 mm3, in order to have no effect on the torque perceived by the driver of the motor vehicle. The diagnostic test then provides for monitoring the torque TRa actually released to the crankshaft 30 due to the test fuel quantity injected by the injection pulse. The released torque TRa is determined as a function of the variation of the rotational speed of the crankshaft 30, which is real time measured by means of an encoder 51 associated to the crankshaft 30 itself.

The relationship between the rotational speed variation of the crankshaft 30 and the released torque is well known to the skilled man, so that it is not described in further detail. The released torque TRa is then compared to an expected value TRe for said torque, which represent the torque that should be released to the crankshaft 30 if the injection pulse actually starts at the preset SOI. The expected value TRe can be determined through an empirically determined map correlating the expected value TRe with a plurality of engine operating parameters, such as engine speed, intake air mass flow and other. The expected value TRe is then sent to an adder that calculates the modulus E of the difference between the actual released torque TRa and the expected one TRe.

If the modulus E is equal or smaller than a threshold value E*, it means that the test injection pulse is actually started at the preset SOI, or at least with an allowable drift, and that the fuel injection system 40 works properly. If conversely the modulus E is greater that the threshold value E*, it means that the test injection pulse is actually started with an unallowable drift, and that a malfunction of the fuel injection system 40 is occurred. In the latter case, the diagnostic test provides for generating an alert signal, for example by activating an indicator light on the dashboard of the vehicle.

As a matter of fact, the threshold value E* defines an admissible torque range that is centered on the expected value TRe for the released torque, and that comprises the values of the released torque for which the drift between the preset SOI and the actual start of the injection pulse is allowable. If the actual released torque TRa falls outside of said admissible torque range, a malfunction of the fuel injection system is detected. The threshold value E* can be determined through an empirically determined map correlating the threshold value E* to a plurality of engine operating parameters, such as engine speed, intake air mass flow and other.

Since the injection timing drift is considered unallowable when it causes at least a vehicle's NMHC, CO, NOx or PM emission to exceed an applicable emission level specified by the antipollution regulation, the threshold value E* is calibrated accordingly. Notwithstanding the present embodiment discloses an admissible torque range centered on the expected value TRe, the invention does not exclude that the range could be asymmetrical with respect to the expected value TRe.

According to an embodiment, the diagnostic test can be performed on a fuel injector 41 only, or can be repeated on some or all the fuel injectors 41. According to an embodiment, the diagnostic test can be performed with the help of a dedicated computer program comprising a program-code for carrying out all the steps of the method described above. The computer program is stored in a data carrier 52 associated to the engine control unit (ECU) 50, which is in turn connected to the encoder 51. In this way, when the ECU 50 executes the computer program, all the steps of the method described above are carried out.

While at least one exemplary embodiment has been presented in the foregoing summary or detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A method of diagnosing a fault in a fuel injection system of an internal combustion engine, comprising:

commanding an injection pulse for injecting a test quantity of fuel into a cylinder of the internal combustion engine;

determining a torque released to a crankshaft of the internal combustion engine due to a combustion of said test quantity of fuel;

calculating a difference between the torque and an expected torque value; and diagnosing the fault if said difference exceeds a threshold value.

2. The method according to claim 1, further comprising determining the expected torque value through an empirically determined map correlating the expected torque value with at least one operating parameters.

3. The method according to claim 1, wherein said commanding the injection pulse is conducted during a fuel cut-off phase of the internal combustion engine.

4. The method according to claim 1, wherein the test quantity of fuel is less than approximately 1 $mm^3$.

5. The method according to claim 1, further comprising determining the torque as a function of a rotational speed variation of the crankshaft due to said injection pulse.

6. The method according to claim 5, further comprising measuring the rotational speed of the crankshaft with an encoder associated with the crankshaft.

7. The method according to claim 1, comprising performing an emergency procedure when the torque falls outside a torque range comprising the expected torque value.

8. The method according to claim 7, further comprising generating an alert signal when performing the emergency procedure.

9. A computer readable medium embodying a computer program product, said computer program product comprising:

a diagnostic program for diagnosing a fault in a fuel injection system of an internal combustion engine, the diagnostic program configured to:

command an injection pulse for injecting a test quantity of fuel into a cylinder of the internal combustion engine;

determine a torque released to a crankshaft of the internal combustion engine due to a combustion of said test quantity of fuel;

calculate a difference between the torque and an expected torque value; and diagnose the fault if said difference exceeds a threshold value.

10. The computer readable medium embodying the computer program product according to claim 9, the diagnostic program further configured to determine the expected torque value through an empirically determined map correlating the expected torque value with at least one operating parameters.

11. The computer readable medium embodying the computer program product according to claim 9, wherein said command of the injection pulse is conducted during a fuel cut-off phase of the internal combustion engine.

12. The computer readable medium embodying the computer program product according to claim 9, wherein the test quantity of fuel is less than approximately 1 $mm^3$.

13. The computer readable medium embodying the computer program product according to claim 12, the diagnostic program configured to determine the torque as a function of a rotational speed variation of the crankshaft due to said injection pulse.

14. The computer readable medium embodying the computer program product according to claim 13, the diagnostic program further configured to measure the rotational speed of the crankshaft with an encoder associated with the crankshaft.

15. The computer readable medium embodying the computer program product according to claim 9, the diagnostic program further configured to perform an emergency procedure when the torque falls outside a torque range comprising the expected torque value.

16. The computer readable medium embodying the computer program product according to claim 15, the diagnostic program further configured to generate an alert signal when performing the emergency procedure.

* * * * *